US005264873A

United States Patent [19]

Fiscella et al.

[11] Patent Number: 5,264,873

[45] Date of Patent: Nov. 23, 1993

[54] TRACTION SURFACES FOR THERMAL PRINTER CAPSTAN DRIVES

[75] Inventors: Marcello D. Fiscella, Fairport; James E. Pickering, Holcomb; Robert R. Brearey, Rochester, all of N.Y.

[73] Assignee: Eastman Kodak Company, Rochester, N.Y.

[21] Appl. No.: 941,285

[22] Filed: Sep. 4, 1992

[51] Int. Cl.[5] ..... B41J 2/32

[52] U.S. Cl. ..... 346/134; 346/136; 346/76 PH

[58] Field of Search ..... 400/611, 612, 617, 634, 400/636, 637, 638, 639, 641; 346/134, 136, 76 PH

[56] References Cited

U.S. PATENT DOCUMENTS

| | | | |
|---|---|---|---|
| 4,502,804 | 3/1985 | Willcox | 400/641 |
| 4,642,659 | 2/1987 | Nagashima et al. | 346/76 PH |
| 4,683,480 | 7/1987 | Sakamoto et al. | 400/617 |
| 4,710,783 | 12/1987 | Caine et al. | 346/76 PH |
| 4,720,714 | 1/1988 | Yukio | 346/134 |
| 4,834,277 | 5/1989 | Gomoll et al. | 226/101 |
| 4,957,378 | 9/1990 | Shima | 400/120 |
| 5,110,227 | 5/1992 | Hatakeyama et al. | 400/617 |

FOREIGN PATENT DOCUMENTS

| | | | |
|---|---|---|---|
| 0012884 | 1/1984 | Japan | 400/641 |
| 0038184 | 2/1985 | Japan | 400/636 |
| 0130962 | 6/1987 | Japan | 400/641 |
| 0132647 | 6/1987 | Japan | 400/611 |
| 0290570 | 12/1987 | Japan | 400/641 |
| 0074371 | 3/1990 | Japan | 400/641 |

OTHER PUBLICATIONS

The Rolling Contact of Two Elastic-Layer-Covered Cylinders Driving a Loaded Sheet in the Nip by Soong et al, ASME Journal of Applied Mechanics, Dec. 1981, vol. 4, pp. 889-894.

*Primary Examiner*—Benjamin R. Fuller
*Assistant Examiner*—Huan Tran
*Attorney, Agent, or Firm*—Milton S. Sales

[57] ABSTRACT

A continuous tone thermal printing apparatus of the type having a printing station and a receiver drive station. The drive station repeatedly advances receiver back and forth through the printing station in conjunction with the advance of successive thermal transfer donor dye colors on a carrier web through the printing station to successively print the overlying different color image separations. The drive station preferably comprises a motor driven capstan roller mounted to bear against one surface of the receiver and a pinch roller mounted to bear and exert pressure against the other surface of the receiver and to press the receiver against the capstan roller and define a nip therebetween. The capstan roller has a high friction receiver engaging surface and is relatively hard and uncompressible, and the pinch roller has a low friction receiver contacting surface and is relatively soft and compressible, such that when the receiver is within the nip, it is driven in the advance direction by motor driven rotation of the high friction capstan surface, and the interfacial shear stress between each roller and the respective receiver surface in the nip area is minimized.

17 Claims, 3 Drawing Sheets

TRACTION SURFACES FOR THERMAL PRINTER CAPSTAN DRIVES

BACKGROUND OF THE INVENTION

1. Field of the Invention

The present invention relates to thermal printers, and more particularly, to thermal printers that employ a capstan drive system to advance receiver paper through the printing station 2. Description of the Prior Art Commonly assigned U.S. Pat. No. 4,710,783 describes a thermal printer apparatus that uses a dye transfer process to form an image on a receiver paper using a multi-colored thermal transfer ribbon from which dye is transferred by heat generated by a thermal print head. The thermal print head is formed of, for example, a plurality of individual thermal heat producing elements, often referred to as heating elements. The receiver paper and the thermal transfer ribbon dye carrier are generally moved relative to the print head and a platen roller at the printing station. The receiver paper is repeatedly fed through the printing station between the print head and platen by the forward and reverse rotation of the platen and/or capstan and roller drive assemblies while the ribbon is advanced to present the three dye transfer colors, thus performing multi-color printing by the successive registration of the three color images as a single print image on the receiver paper.

As described more completely in the above-referenced '783 patent, incorporated herein by reference in its entirety, the print head is organized into a plurality of groups of heating elements that are capable of being energized for predetermined time periods that determine the gray scale of an image pixel transferred. Thermal dye transfer printer apparatus offer the advantage of true "continuous tone" dye density transfer. By varying the heat applied to each heating element to the carrier, a variable dye density image pixel is formed in the receiver. When a particular heating element is energized, it is heated and causes dye to transfer (e.g., by sublimation) from the carrier to the image pixel in the receiver paper image frame. The density, or darkness, of the printed dye is a function of the temperature of the heating element and the time the carrier is heated by that element. In other words, the heat delivered from the heating element to the carrier causes dye to transfer to an image pixel of a receiver. The amount of dye is directly related to the amount of heat transferred to the carrier.

As mentioned above, thermal printers successively overlay color dyes to form a full color image onto the receiver paper. Alignment of each successive color is crucial for good image quality. Capstan drive systems rely on a paper nip to drive the receiver paper past the print head and platen for each successive color. The capstan is intended to precisely drive the paper past the head in a synchronized manner with aligned printing of the linear array of the heating elements of the print head which are themselves individually actuated by digital image line data in storage buffers that are successively loaded for each line with digital data from memory registers of the microprocessor-based control system depicted, for example, in the above-incorporated '783 patent.

The misregistration of the individual lines of the successively transferred color images is more or less noticeable depending on the content of the image being printed. Slight misregistrations of the successive image pixels of a pictorial scene are usually acceptable. However, even slight misregistration of the successive cyan, magenta and yellow image pixels forming black printed text may cause a halo effect of the misregistered colors at the borders of the black characters. Often it is desirable to print both pictorial scenes and alphanumeric characters as part of the same printed image, and misregistration may be only apparent in the printing of the characters.

Misregistration occurs from errors between the motion of the paper and the line placement of the head for each successively transferred color image. Since the receiver paper is a non-rigid structure (i.e., like a rope), the paper must be maintained under near constant tension to ensure accurate motion. Paper under constant tension will maintain a predictable path through the head platen nip and this ensuring good synchronization between the paper motion and the line placement.

Various types of driving systems have been proposed to prevent misalignment of the color planes in either the front to back or side to side direction relative to the thermal print head. In the case of the standard capstan and pinch roller drive systems presently employed in certain thermal printing apparatus, shifts in the color planes occur due to uncontrolled back tension on the receiver paper. Capstan and pinch roller systems rely on the friction of the capstan to drive the receiver sheet past the thermal print head to form an image made up from a matrix of pixels, and if the slip occurr on the friction interface between the capstan and receiver interface, color misregistration will occur. Color misregistration can also occur if a speed differential exists between the capstan roller and pinch roller, because the speed differential creates a shear force on the receiver paper that will result in slip. Capstan drive systems always intend the capstan roller to drive the receiver sheet and the pinch roller to be the follower; thus the pinch roller should not induce any shearing force to the receiver paper that could cause receiver slip. The present capstan drive systems do not prevent the pinch roller from inducing shear forces to the receiver paper. In addition the current systems do not allow shear forces to be relieved on the capstan roller. Thus, the induced shear forces on the paper from the capstan roller will cause slippage of the receiver paper in the nip area, and this slippage will show up as color misregistration.

Moreover, the uncontrolled back tension condition occurs because of the variability of the coefficient of friction at the head/receiver interface during printing. A stick/slip phenomena occurs at the head, due to the various levels of heat employed to create different density levels of the individual pixels. Therefore, the total tension on the receiver paper at any given point includes the slippage of the receiver paper in the nip area and the variable force of the head friction, and, as a result, the total paper tension varies during and from color pass to color pass, thus resulting in color misregistration.

Constant tension control can be sought through an additional mechanism placed upstream from the print head as set forth in U.S. Pat. No. 4,642,659. The printer drive apparatus disclosed in the '659 patent employs a hard capstan roller and a softer pinch roller to form a driving nip to transport the receiver paper through the head and platen interface at the print station. The image forming method comprises multiple passes through the print station to transfer each color dye image to the receiver. For example, a yellow, magenta, cyan and/or black dye pass for each printed image is made. In the '659 patent, the tension mechanism creates a back tension on the receiver greater than the force disturbance created during the printing process by virtue of the additional upstream capstan roller and pinch roller.

Other mechanisms for providing constant tension in the normal and reverse direction of the receiver through a print station employing combinations of hard and soft rollers and/or platens in both thermal transfer printing and in other printing technologies are disclosed in U.S. Pat. Nos. 4,502,804, 4,720,714, 4,834,277, and 4,957,378. Typically, in these patents, the platen roller at the print station is driven along with upstream and/or downstream capstan rollers which may operate as a tension roller to apply tension to either discrete sheets of receiver paper moved through the printing station or the continuous web of receiver paper moved bidirectionally therethrough from a paper supply reel.

SUMMARY OF THE INVENTION

The present invention solves the above-discussed problems of the prior art printers by an improved capstan and pinch roller design. The new design reduces the shear forces created by the receiver driving nip that can cause slippage between the receive sheet and the capstan roller, and leads to misregistration. In the new design, the grooves in the capstan allow paper displacement into the grooves to reduce the shear force on the receive sheet without losing traction between the receiver sheet and the capstan. The low coefficient of friction coating on the pinch roller allow the receiver sheet to slip relative to the pinch, thus the pinch roller cannot induce the receiver sheet to slip relative to the capstan. With this new system, the shear force influences created by a nip drive are reduced below the frictional force of the capstan roller, therefore no slippage will occur between the receive and the capstan roller, and excellent registration will be achieved.

This is accomplished in the context of a thermal printer comprising a print station comprising a thermal print head comprising a plurality of heating elements and a platen drum mounted for forward and reverse rotation to present a receiving image paper to the thermal print head in a first, print direction of conveyance and to again present said receiving image paper to said thermal print head pursuant to the successive printing of different, overlying color separation images on the paper; driving means for driving the paper in the first print direction and a second, reverse direction comprising a capstan drive and a pinch roller adapted to bear against opposite surfaces of the paper and impart the direction of conveyance by rotating the capstan roller against the paper and pinch roller; means for advancing a dye carrier between the receiving paper and the print head heating elements to cause dye to transfer from the carrier to an image pixel in the receiver image by operation of the thermal printer heating elements; wherein the pinch roller is constructed of a hard core, such as steel, with a low durometer elastomer covering the hard core, which, in turn, is covered with a low friction surface. The low friction surface may be constructed of a thin layer of teflon or a high durometer elastomer, such polyethylene.

The capstan roller is preferably constructed of a hard steel core with a high friction, rigid surface that may be achieved by threading the surface, grit blasting the surface or a combination of threading and grit blasting. The high friction, rigid surface may be also achieved by using a thin layer of a low durometer elastomer, such as urethane.

BRIEF DESCRIPTION OF THE DRAWINGS

These and other features and advantages of the present invention will become more apparent by reference to the following detailed description thereof in conjunction with the drawings, wherein like parts are denoted by like reference numerals and wherein.

The drawings are not necessarily to scale.

DESCRIPTION OF THE PREFERRED EMBODIMENTS

Figure 1:
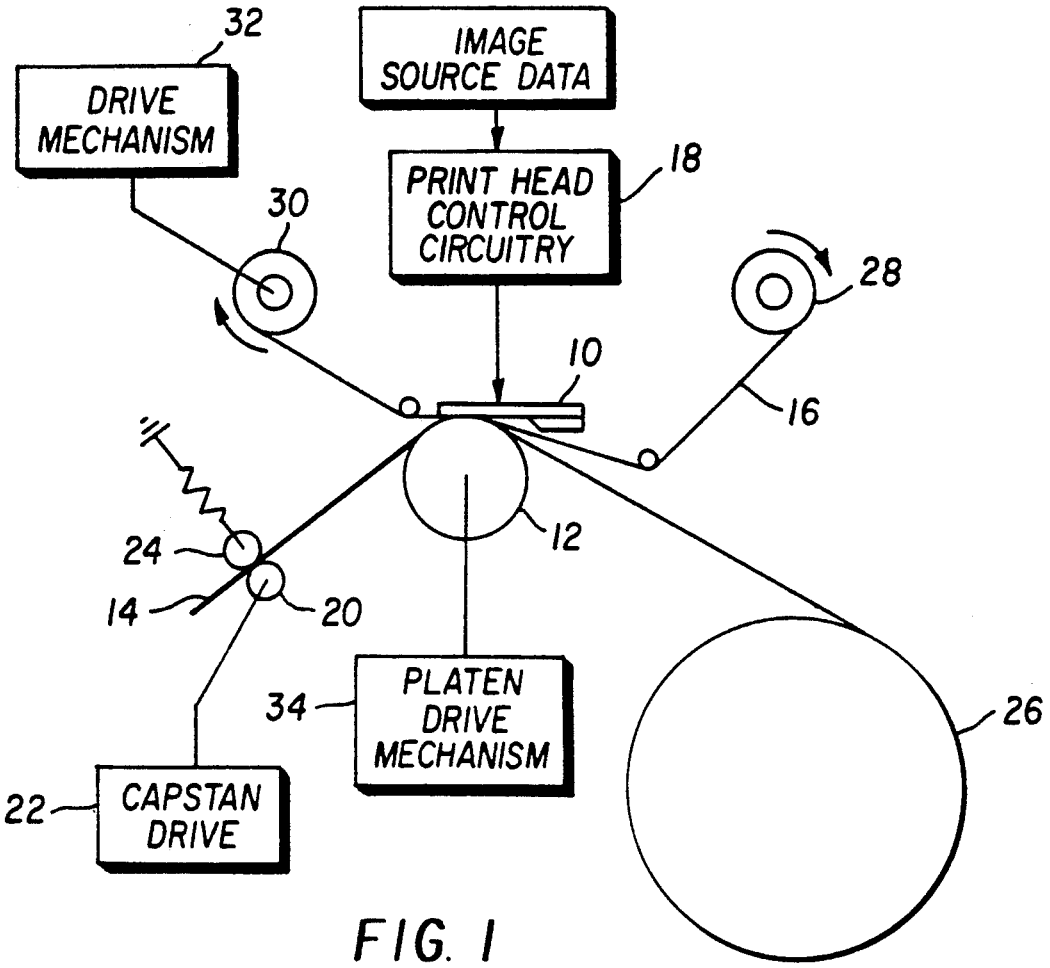
FIG. 1 is a schematic illustration of a thermal printer which can be employed to make continuous tone dye images in accordance with the invention.

Referring now to FIG. 1, a side view schematic illustration of a thermal printer apparatus which is adapted to print color images on a receiver member from dyes transferred thereto from a carrier member. The thermal print head 10 is depicted in relation to the platen drum 12 such that the receiver member 14 (a continuous web of paper in this illustration) and the donor dye carrier web 16 bear against one another, the platen drum 12 and the thermal print head 10 in a manner well known in the prior art and illustrated in the above-incorporated '783 patent FIG. 1. Unlike the '783 patent, however, the platen drum 12 in accordance with the present invention, is not itself driven by a drive mechanism to operate as the principal means of advancing a receiver member 14 bidirectionally through the the printing station.

The print head 10 includes a plurality of spaced-apart heating elements arranged in a line or set of lines transverse to the paper receiver member 14 and donor dye carrier web 16 in a fashion well known in the prior art. The individual heating elements press the carrier web 16 against the paper receiver member 14 and the platen drum 12 within the printing station. During printing, the heating elements are addressed and selectively energized as the carrier web 16 and the receiver member 14 are continuously advanced under the control of the print head control circuitry 18. Accordingly, the resultant dye image pixel will be somewhat larger than if the carrier and receiver were stationary during dye transfer. The movement of the carrier is necessary to reduce sticking of the carrier to the heating elements in the print head 10. Sticking, release and slippage may still be encountered depending on the heat intensity and resultant color density varies from element to element and color to color under the control of the print head control circuitry 18 and data supplied thereto to achieve the resultant tone and density at each individual pixel. It is this effect that can cause misregistration of the successive color images, apart from any misregistration caused by the failure of the drive system itself to operate consistently.

The drive system of the thermal printer apparatus as mentioned above, may involve driving the platen drum 12 as a capstan drive or drive roller in association with a separate capstan drive alone or in association with spaced-apart capstan drive and pinch roller assemblies. In FIG. 1, the drive mechanism for the receiver member 14 comprises the capstan 20 and its associated capstan drive 22 bearing against one surface of the receiver member 14, the other surface of which bears against a load-biased pinch roller 24 in order to advance the continuous web receiver member 14 through the printing station in a forward direction unwinding the receiver member 14 from the receiver supply roll 26 and in a reverse direction through the printing station in a fashion well known in the prior art.

Simultaneously, the donor dye carrier web 16 is advanced from a donor supply reel 28 to a donor take-up reel 30 by donor dye carrier web drive mechanism 32 also operating in a fashion well known in the prior art.

Figure 2:
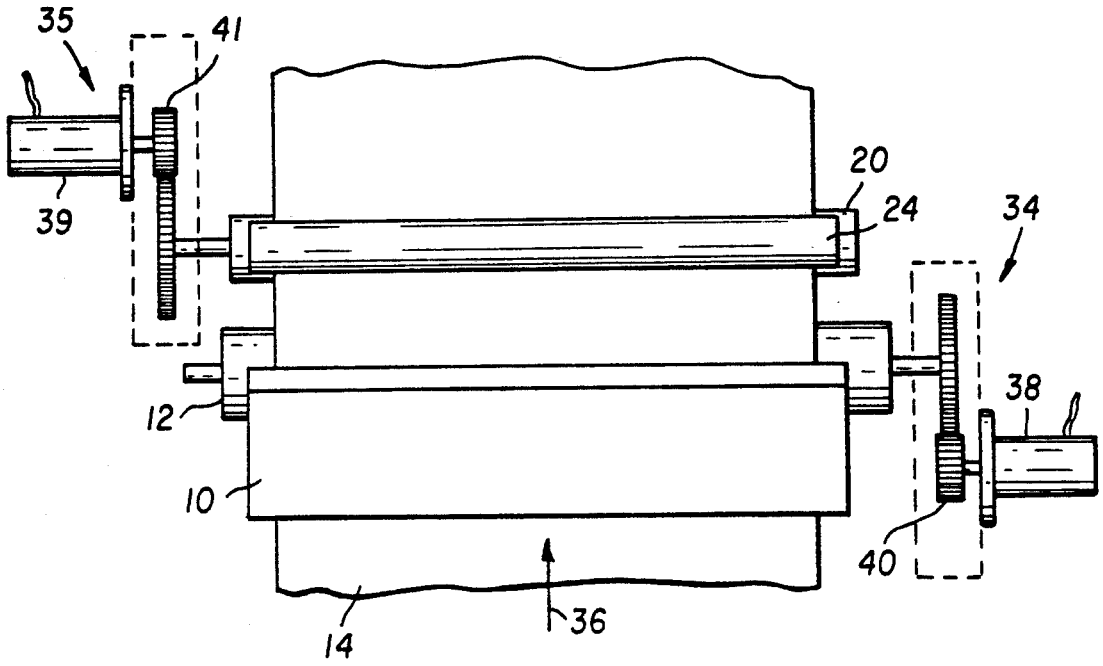
FIG. 2 is a top schematic illustration of the coupling of the thermal printer of FIG. 1.

Turning now to FIG. 2, it illustrates a top schematic view of a receiver paper sheet 14 in the printing station comprising the thermal print head 10 and the platen drum 12 together with the platen drive mechanism 34 and the drive station comprising the capstan 20, the pinch roller 24, and the capstan drive mechanism 35. In FIG. 2, the drive mechanisms 34 and 35 comprise the DC motors 38 and 39, which are coupled through the transmission system 40 and 41 to the axles of the platen drum 12 and the capstan 20. The motors 38 and 39 are preferably low speed, low torque motors which are selected such that steady torque is developed through the transmission systems 40, 41, therefore allowing the receiver paper 14 to move in the print and reverse directions. The total receiver paper tension will thus equal the sum of the web tension created by the capstan and platen drive torques.

Figure 3:
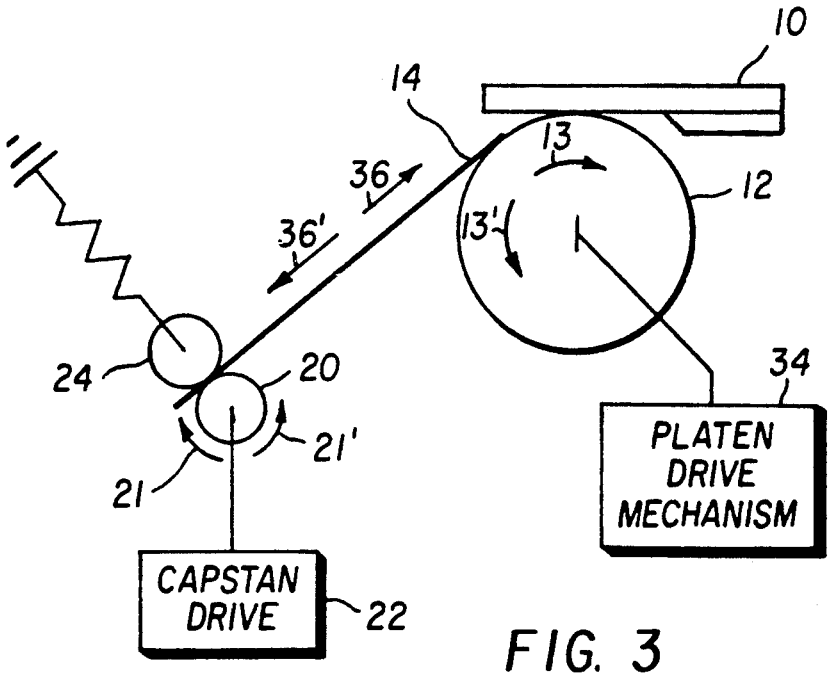
FIG. 3 is a partial illustration of the schematic illustration of FIG. 1 emphasizing the application of receiver paper tension in accordance with the invention.

Turning now to FIG. 3, the forward and reverse directions rotation and of application of the capstan drive torque and the platen drive torque are illustrated by the arrows labeled 21, 21' and 13, 13', respectively. The forward and reverse receiver paper directions of movement and tension are denoted by the arrows 36 and 36', respectively. The receiver paper 14 is tensioned as it is moved between the drive station comprising the capstan 20 and pinch roller 24 and the print station comprising the thermal print head 10, the platen drum 12, and the donor dye carrier web 16 (not illustrated).

In the case of the standard capstan and pinch roller drive systems presently employed in thermal printing systems, shifts in the color planes will occur due to slippage between the receiver paper 14 and the capstan 20 and pinch roller 24. This slippage has two primary contributing factors. The first factor is the micro-slip caused by the interfacial shear stress distribution that result from deformation of the compliant layer of the pinch roller. Details of this are discussed in a technical paper titled "The Rolling Contact of Two Elastic-Layer-Covered Cylinders Driving a Loaded Sheet in the Nip" by T. C. Soong and C. Li, *ASME Journal of Applied Mechanics,* December 1981, Vol. 48, pp. 889–894.

Figure 4:
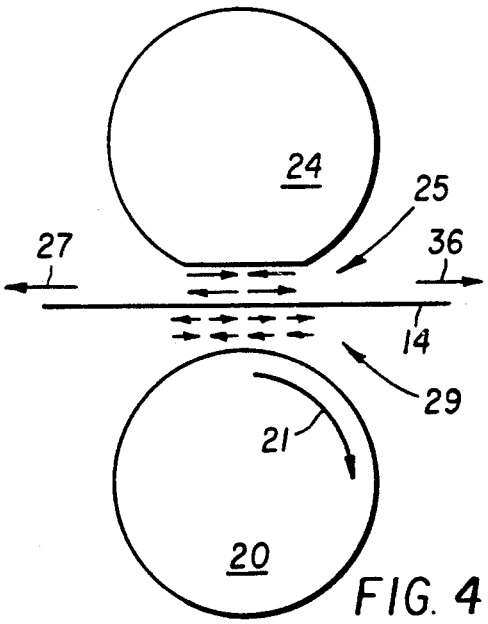
FIGS. 4 and 5 are schematic illustrations of pinch roller/receiver paper interfacial shear stress and capstan roller/receiver paper interfacial shear stress in clockwise and counterclockwise rotation.
Figure 5:
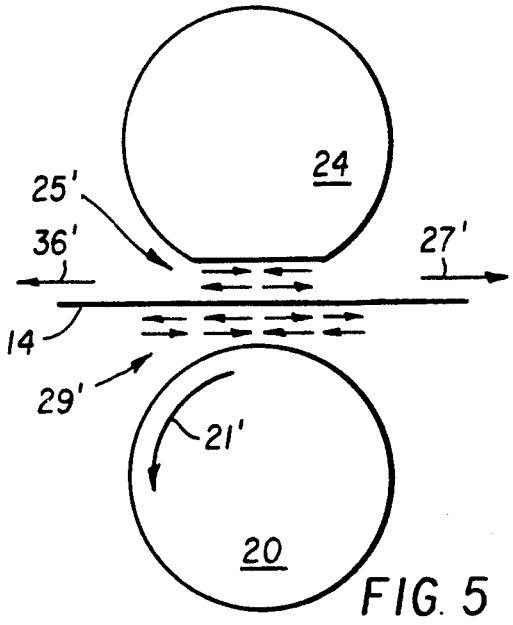

FIGS. 4 and 5 illustrate the variation in the interfacial shear stresses in the printing (clockwise) and rewind (counterclockwise) directions 21 and 21', respectively. The deformation of the compliant cover layer of the pinch roller 24 introduces shear stresses 25, 25' on the receiver paper 14 which in turn are reacted to the capstan roller 20 at 29, 29' as shown in FIGS. 4 and 5.

When the receiver paper 14 is transported in the printing direction 36, a tension 27 is also introduced in the receiver paper 14 as shown in FIG. 4. The capstan 20 receiver paper 14 interfacial shear stresses 29 will be the vectorial sum of the pinch roller 24 interfacial stresses 25 and the tension 27 in the receiver paper 14. In order for the receiver paper 14 to be transported without slip, the frictional capabilities of the capstan 20/receiver paper 14 interface must be greater than the interfacial shear stress 29.

The shear stress distribution 25', 29' shown in FIG. 5 exists when there is little or no tension 27' in the paper, such as in the rewind direction 36' of the printer, and will cause the receiver 14 to slip with respect to the capstan 20 if the coefficient of friction is not sufficient at the interface. By adding tension 27 to the receiver in the printing direction, as shown in FIG. 4, a different shear stress distribution 25, 29 will result in a greater magnitude of micro-slip in the printing direction 36. This difference in the amount of micro-slip that occurs in each direction causes misregistration of the color planes.

Figure 6:
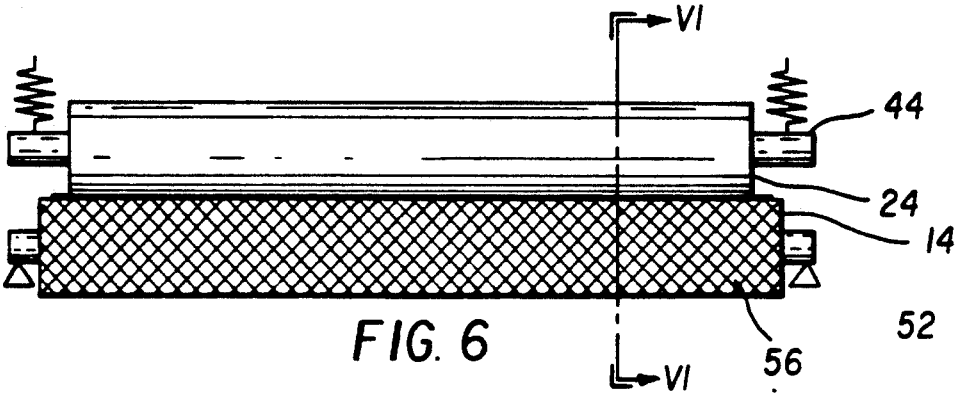
FIGS. 6–8 are illustrations of the capstan/P inch roller nip area and depth.
Figure 7:
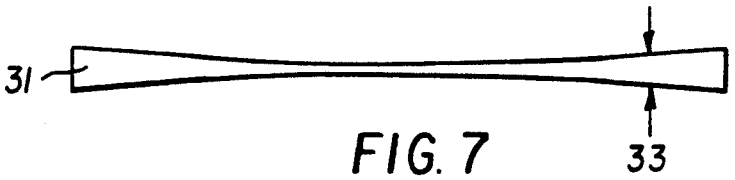
Figure 8:
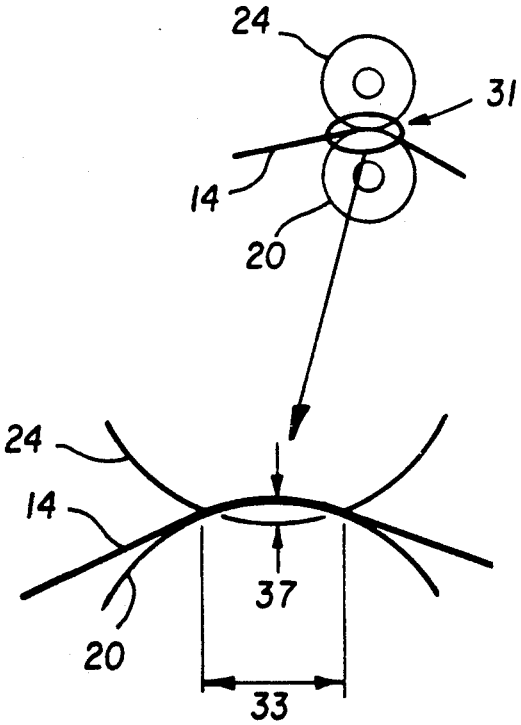

FIGS. 6–8 illustrate the contact or nip area of the pinch roller 24/receiver paper 14 interface and the capstan 20 receiver paper 14 interface of FIGS. 4 and 5. The receiver paper 14 is transported by the frictional interface or nip between the capstan 20 and the receiver paper 14. The traction at this interface is increased by forcing the receiver paper 14 against the capstan roller 20 with the pinch roller 24, which has a compliant surface. The nip area 31 is defined as the location of this interface. Deformation of the compliant layer of the pinch roller 24 and the receiver paper 14 in the nip area 31 will result in a particular nip width 33 and nip depth 37. The nip width 33 and nip depth 37 will vary along the length of the pinch roller 24 because of the longitudinal flexibility of capstan roller 20 and pinch roller 24.

Additionally, the nip width and depth variation along the length of the rollers, as shown in FIGS. 6–8, will cause variations in the amount of micro-slip across the page. This may result in wrinkles, if the receiver paper is too thin, or introduce a rotation of the color planes if there is asymmetry of the pinch load. In addition, as thermal printers continue to increase in resolution, the absolute displace of each color plane becomes smaller, thus harder to control.

Figure 9:
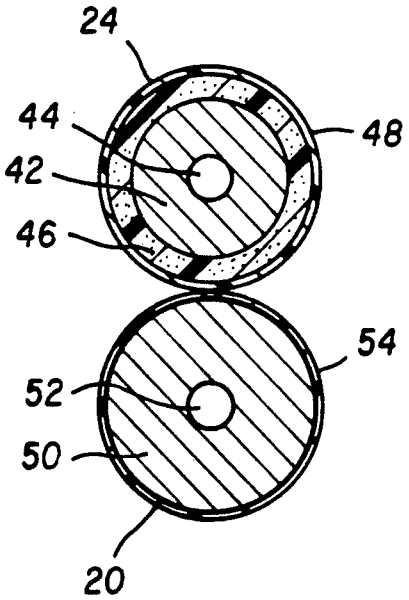
FIG. 9 is a cross-section view along line VI—VI of FIG. 6 illustrating the construction of the capstan and pinch rollers of the present invention.

Turning now to FIG. 9, it illustrates in cross-section the construction of the pinch roller 24 and the capstan 20 in accordance with the present invention. The pinch roller 24 is constructed of a hard core 42 such as steel, with a bearing journal 44 machined on both ends. A low durometer elastomer 46 covers the hard core 42 and is, in turn, covered with a low friction surface 48. The low friction surface 48 may be constructed of a thin layer of Teflon or a high durometer elastomer, such as polyethylene, or any low friction material.

The capstan 20 is constructed of a hard steel core 50 with a bearing journal 52 machined on both ends. The high friction, rigid surface 54 may be achieved by threading the surface, grit blasting the surface or a combination of threading and grit blasting. The high friction, rigid surface 54 may be also achieved by using a thin layer of a low durometer elastomer, such as urethane.

Preferably, the capstan 20 is constructed of a steel core 50 with thin grooves 56 (shown in FIG. 6) machined into the surface. For example, the grooves 56 can be machined on a lathe with a pitch of 11 threads per inch with opposing threads at a 4 lead start equally spaced around the circumference. The width of a groove 56 can be 0.010 inches, the depth of a groove 56 can be 0.010 inches, and the groove 56 can have an included angle of 60 degrees. The V-shaped grooves 56 thus form a shallow, cross-hatch pattern.

Alternatively, the capstan surface 54 can be constructed on the core 50 by particle blasting it with grits such as silica, or glass beads, to create small craters distributed over the driving surface 54 to increase the coefficient of friction of the capstan roller 20.

If any of these alternate constructions, or alternatively to them, it may be desirable to overcoat the surface 54 with a thin layer of a low durometer elastomer, e.g., urethane. The overlying urethane coating is thin enough to not offer much compliance, but will provide a high friction traction surface 54.

The employment of the above-described capstan 20 and pinch roller 24 in the preferred embodiments for reducing the interfacial shear stresses 25 and 29 (FIGS. 4 and 5) advantageously reduces the image misregistration caused thereby inexpensively and simply, involving few additional parts subject to breakdown or otherwise negatively affecting the printing system.

The invention having been described in detail with particular reference to certain preferred embodiments thereof will be understood to encompass variations and modifications thereof and equivalents thereto within the spirit and scope of the invention defined by the appended claims.

what is claimed is:

1. In a thermal transfer color printer for printing a multi-color image by successively printing different color separation images in registration on a surface of a sheet or web receiver, apparatus for avoiding misregistrations in the printing of the successive color separation images comprising:

a print station comprising a thermal print head, having a plurality of heating elements and a platen drum mounted for forward rotation during presentation of the receiver to the thermal print head in a print direction of conveyance pursuant to the successive printing of the different color separation images on the receiver;

means for advancing a dye carrier between the receiver and the print head heating elements to cause dye to transfer from the carrier to an image pixel in each color separation image by operation of the thermal printer heating elements; and capstan drive means for advancing the receiver in the print direction to the print station comprising a motor driven capstan roller formed with a noncompressible core and a friction increasing receiver engaging surface over the noncompressible core mounted to bear against a first surface of the receiver and a pinch roller formed with a compressible layer of elastomeric material and a friction reducing receiver contacting surface over the compressible layer mounted to bear and exert pressure against a second surface of the receiver; and means for applying pressure between said pinch roller and said capstan drive roller to press the receiver between the pinch roller and the capstan roller sufficiently to deform the compressible layer of elastomeric material of the pinch roller and define a nip area therebetween, wherein the interfacial shear stress between each roller surface and the respective first and second receiver surfaces in the nip area is minimized.

2. The thermal transfer color printer of claim 1 wherein the friction increasing surface treatment is effected by V-shaped grooves formed in the receiver engaging surface of the noncompressible capstan roller core in a cross-hatched pattern.

3. The thermal transfer color printer of claim 1 wherein the friction increasing surface treatment is effected by grit blasting the receiver engaging surface of the noncompressible capstan roller core to crater the receiver engaging surface.

4. The thermal transfer color printer of claim 1 wherein the friction increasing surface treatment is effected by coating the receiver engaging surface of the noncompressible capstan roller core with a low durometer elastomeric material.

5. The thermal transfer color printer of claim 1 wherein the pinch roller is fabricated of a noncompressible, inner pinch roller core with the compressible layer of elastomeric material overlying the inner pinch roller core and covered with a low friction surface coating forming the friction reducing receiver contacting surface.

6. The apparatus of claim 5 wherein the friction increasing surface treatment is effected by V-shaped grooves formed in the surface of the capstan roller core in a cross-hatched pattern.

7. The apparatus of claim 5 wherein the friction increasing surface treatment is effected by grit blasting the surface of the capstan roller core to crater the surface.

8. The apparatus of claim 5 wherein the friction increasing surface treatment is effected by coating the capstan roller core surface with a low durometer elastomeric material.

9. The thermal transfer color printer of claim 1 wherein the pinch roller is fabricated of a noncompressible, inner pinch roller core with the receiver contacting surface overlying the pinch roller core comprising a relatively compressible layer of elastomeric material with a low friction surface coating over the relatively compressible layer.

10. Apparatus for printing images on a receiver of the type comprising:

a rotatable platen drum;

a print head adapted to print images on the receiver when the receiver is moved between the print head and the platen drum; and capstan drive means for advancing the receiver to the print head comprising a motor driven capstan roller formed with a noncompressible core and a friction increasing receiver engaging surface mounted to bear against a first surface of the receiver and a pinch roller formed with a compressible layer of elastomeric material and a friction reducing receiver contacting surface mounted to bear and exert pressure against a second surface of the receiver; and means for applying pressure between said pinch roller and said capstan drive roller to press the receiver between the pinch roller and the capstan roller sufficiently to deform the compressible layer of elastomeric material of the pinch roller and define a nip area therebetwen, such that when the receiver is pressed within the nip area, it is driven by motor driven rotation of the high friction capstan surface, and the interfacial shear stress between each roller surface and the respective first and second receiver surfaces in the nip area is minimized.

11. The apparatus of claim 10 wherein the friction increasing surface treatment is effected by V-shaped grooves formed in the receiver engaging surface of the noncompressible capstan roller core in a cross-hatched pattern.

12. The apparatus of claim 10 wherein the friction increasing surface treatment is effected by grit blasting the receiver engaging surface of the noncompressible capstan roller core to crater the receiver engaging surface.

13. The apparatus of claim 10 wherein the friction increasing surface treatment is effected by coating the receiver engaging surface of the noncompressible capstan roller core with a low durometer elastomeric material.

14. The apparatus of claim 10 wherein the pinch roller is fabricated of a noncompressible, inner pinch roller core with the compressible layer of elastomeric material overlying the inner pinch roller core and covered with a low friction surface coating forming the friction reducing receiver contacting surface.

15. The apparatus of claim 14 wherein the friction increasing surface treatment is effected by V-shaped grooves formed in the surface of the capstan roller core in a cross-hatched pattern.

16. The apparatus of claim 14 wherein the friction increasing surface treatment is effected by grit blasting the surface of the capstan roller core to crater the surface.

17. The apparatus of claim 14 wherein the friction increasing surface treatment is effected by coating the capstan roller core surface with a low durometer elastomeric material.

* * * * *